US012523202B2

(12) United States Patent
Yajima

(10) Patent No.: US 12,523,202 B2
(45) Date of Patent: Jan. 13, 2026

(54) LIQUID SUPPLY DEVICE

(71) Applicant: KOGANEI CORPORATION, Koganei (JP)

(72) Inventor: Takeo Yajima, Tokyo (JP)

(73) Assignee: KOGANEI CORPORATION, Tokyo (JP)

( * ) Notice: Subject to any disclaimer, the term of this patent is extended or adjusted under 35 U.S.C. 154(b) by 15 days.

(21) Appl. No.: 18/693,307

(22) PCT Filed: Aug. 17, 2022

(86) PCT No.: PCT/JP2022/031117
§ 371 (c)(1),
(2) Date: Oct. 28, 2024

(87) PCT Pub. No.: WO2023/047847
PCT Pub. Date: Mar. 30, 2023

(65) Prior Publication Data

US 2025/0059962 A1 Feb. 20, 2025

(30) Foreign Application Priority Data

Sep. 22, 2021 (JP) ..... 2021-154195

(51) Int. Cl.
*F04B 1/14* (2020.01)
*F04B 1/146* (2020.01)
*F04B 1/16* (2006.01)

(52) U.S. Cl.
CPC ..... *F04B 1/146* (2013.01); *F04B 1/16* (2013.01)

(58) Field of Classification Search
CPC .... F04B 53/00; F04B 9/04; F04B 1/16; F04B 1/146
See application file for complete search history.

(56) References Cited

U.S. PATENT DOCUMENTS 6,206,649 B1 * 3/2001 Yie ..... F04B 1/124 417/269
2005/0058551 A1 * 3/2005 Wakita ..... F04B 27/1054 417/269

(Continued)

FOREIGN PATENT DOCUMENTS

CN 103527620 A 1/2014
JP H03-083824 U1 8/1991

(Continued)

OTHER PUBLICATIONS

International Search Report mailed on Oct. 4, 2022, in connection with corresponding International Application No. PCT/JP2022/031117 (5 pp., including machine-generated English translation).

*Primary Examiner* — Abiy Teka
(74) *Attorney, Agent, or Firm* — McCormick, Paulding & Huber PLLC

(57) ABSTRACT

A liquid supply device 10 has a pump unit 11 in which a plurality of pump members are provided; a housing 15 in which a plurality of drive rods for driving the pump members are integrated; a drive roller 32 which rotation about a center rotation axis in a direction lateral to a reciprocation direction of the driving rod; a cam member 43 on whose end surface a cam surface 48 contacted with the drive roller 32 is provided; a magnet 66 provided on an outer peripheral portion of the cam member 43; and a magnetic sensor 71 that senses a magnetic field of the magnet 66 to output a rotation signal.

9 Claims, 8 Drawing Sheets

(56) References Cited

U.S. PATENT DOCUMENTS

| | | | | |
|---|---|---|---|---|
| 2009/0142205 | A1* | 6/2009 | Yajima | F04B 43/084 417/375 |
| 2011/0253750 | A1* | 10/2011 | Takeishi | F04B 43/08 222/207 |
| 2014/0170005 | A1* | 6/2014 | Yajima | F04B 11/005 417/539 |

FOREIGN PATENT DOCUMENTS

| | | | |
|---|---|---|---|
| JP | 5956920 | B2 | 6/2014 |
| WO | 2014/092124 | A1 | 6/2014 |

* cited by examiner

FIG. 4( A )
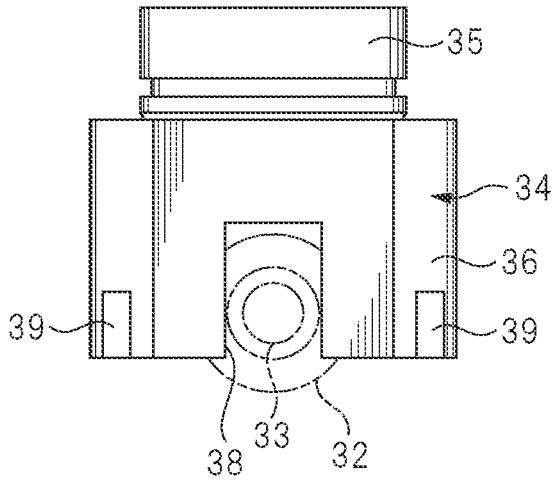
FIG. 4( B )
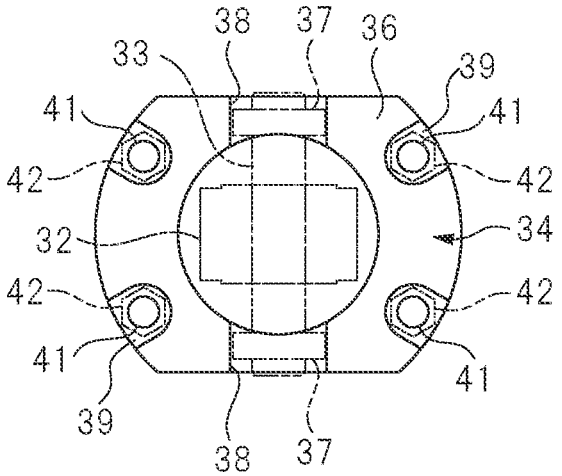

FIG. 5( A )
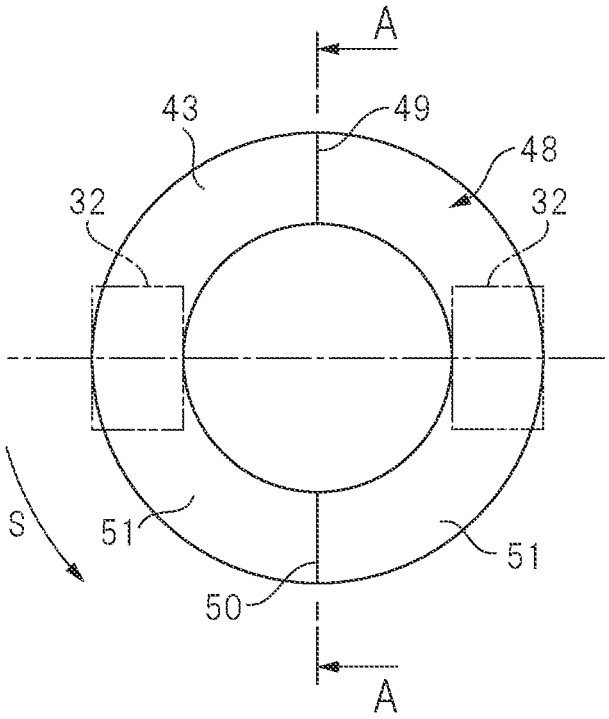
FIG. 5( B )
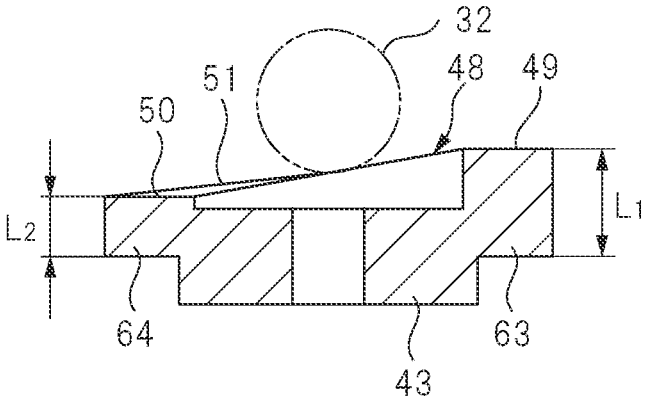

LIQUID SUPPLY DEVICE

CROSS-REFERENCE TO RELATED APPLICATIONS

This application is a National Stage application of International Patent Application No. PCT/JP2022/031117, filed on Aug. 17, 2022, which claims priority to Japanese Patent Application No. 2021-154195, filed on Sep. 22, 2021, each of which is hereby incorporated by reference in its entirety.

TECHNICAL FIELD

The present invention relates to a liquid supply device that drives a plurality of pump members to continuously discharge a liquid.

BACKGROUND

A liquid supply device is used to apply a liquid such as a photoresist liquid to a surface of a liquid crystal display substrate. The liquid supply device is classified into a piston type, a bellows type, a tubephragm type, and the like depending on members incorporated therein. The piston type has a piston that reciprocates in a cylinder chamber, and is a type of expanding and contracting, by the piston, a pump chamber partitioned by the piston chamber and the piston. The bellows type has a bellows that is accommodated in a pump block and extends and contracts, and is a type of expanding and contracting, by the bellows, a pump chamber partitioned by the pump block and the bellows. The tubephragm type has a tubephragm with a pump chamber formed inside, and is a type of expanding and contracting the pump chamber by supplying and discharging an indirect medium to and from an external drive chamber.

Patent Document 1 discloses liquid supply devices of a piston type and a tubephragm type. The liquid supply device has a plurality of pump chambers in order to continuously discharge the liquid. A plurality of rods for expanding and contracting the respective pump chambers are driven by one electric motor through a cam member. A constant amount of liquids can be continuously discharged by shifting discharge timing of each pump through the cam member.

Patent Document 1: Japanese Patent No. 5956920

SUMMARY

Problems to be Solved by the Invention

A failure of the pump can be detected by attaching an encoder for monitoring rotation of an output shaft of the electric motor to a casing of the electric motor in the liquid supply device. If the failure of the device is detected by detecting the rotation of the output shaft with the encoder and even if the electric motor rotates at a predetermined number of revolutions, the fault cannot be detected when the cam member does not rotate at the set number of revolutions. Moreover, a problem arises in that the encoder becomes expensive if a signal processing circuit from the encoder is included.

An object of the present invention is to provide a liquid supply device that can detect whether the cam member is reliably rotating by a simple mechanism.

Means for Solving the Problems

A liquid supply device includes: a pump unit provided with a plurality of pump members for expanding and contracting respective pump chambers; a housing incorporating a plurality of drive rods for driving the plurality of pump members at different timing; a drive roller provided on the drive rods and rotating around a rotation center axis in a direction lateral to a reciprocating direction of the drive rod; a cam member whose end surface a cam surface contacted by the drive roller is provided on and that is rotated around a rotation center axis parallel to the reciprocating direction of the drive rod by a rotation drive source; a magnet provided on an outer peripheral portion of the cam member; and a magnetic sensor provided in the housing and sensing a magnetic force of the magnet to output a rotation signal.

Effects of the Invention

The magnetic field of the magnet provided on the outer peripheral portion of the cam member is detected by the magnetic sensor provided in the housing, and the rotation of the cam member is detected, so that the rotation stop of the cam member due to the motor failure, the fault of the rotation transmission to the cam member from the motor, and the like can be reliably detected by the low cost and simply mechanism. By using the magnet to detect the rotation of the cam member, the durability of the liquid supply device can be improved.

BRIEF DESCRIPTIONS OF THE DRAWINGS

FIG. 4(A) is a front view showing a guide cylinder illustrated in FIG. 2;

FIG. 4(B) is a bottom view of FIG. 4(A);

FIG. 5(A) is a plan view of a cam member;

FIG. 5(B) is a sectional view taken along line A-A in FIG. 5(A);

DETAILED DESCRIPTION

Figure 1:
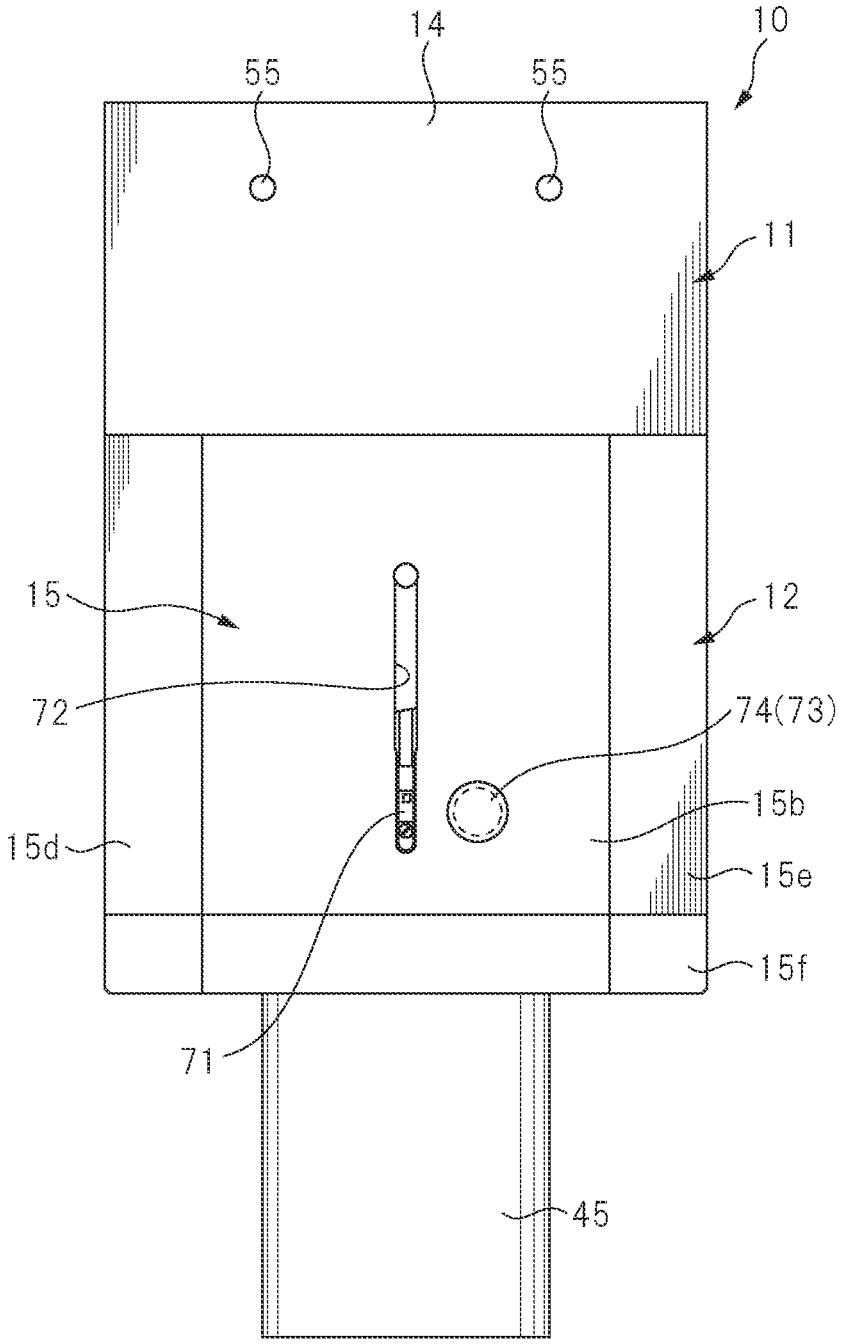
FIG. 1 is a plan view of a liquid supply device that is one embodiment.
Figure 2:
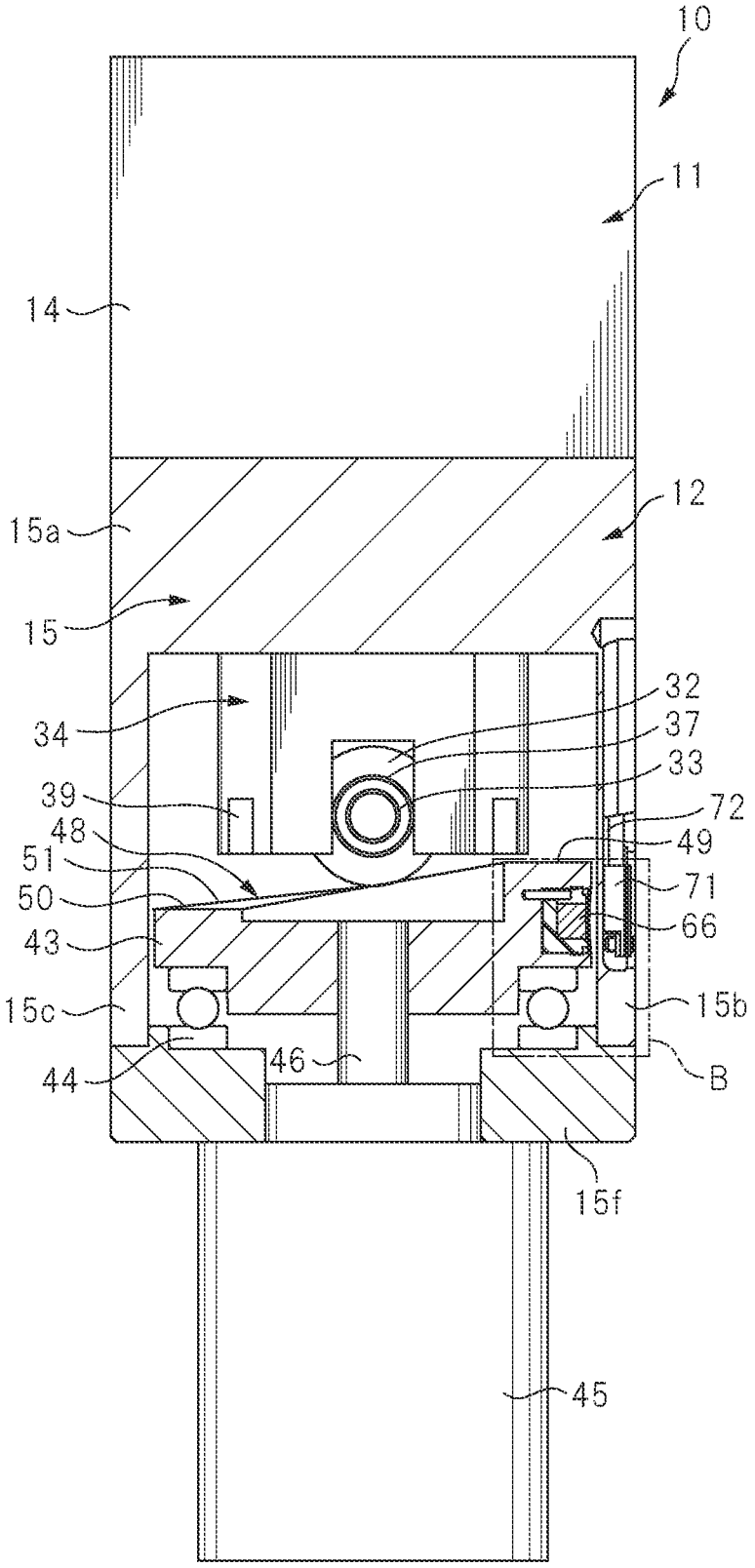
FIG. 2 is an enlarged sectional view on a front side of FIG. 1.
Figure 3:
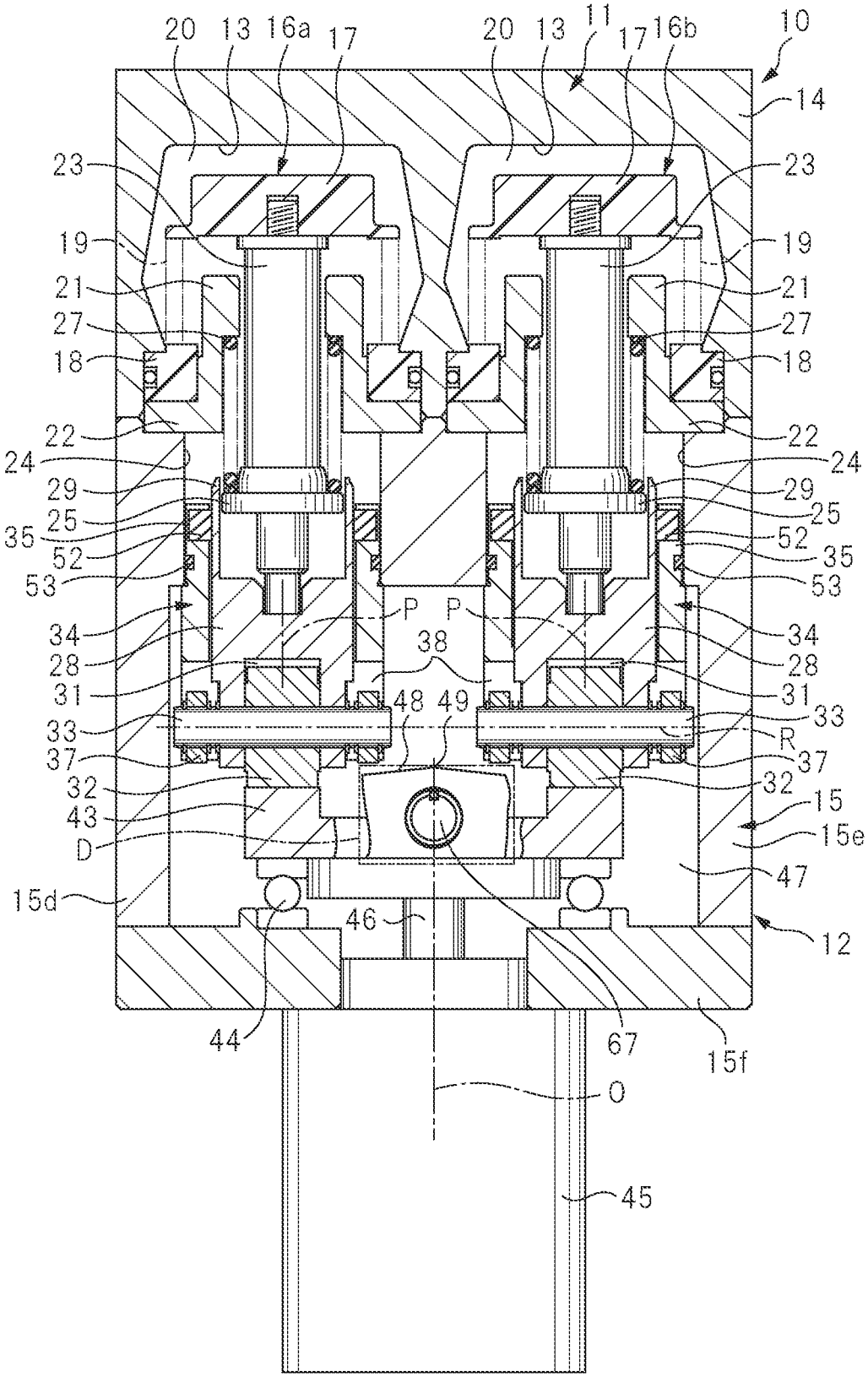
FIG. 3 is an enlarged sectional view on a plane side of FIG. 1.
Figure 6:
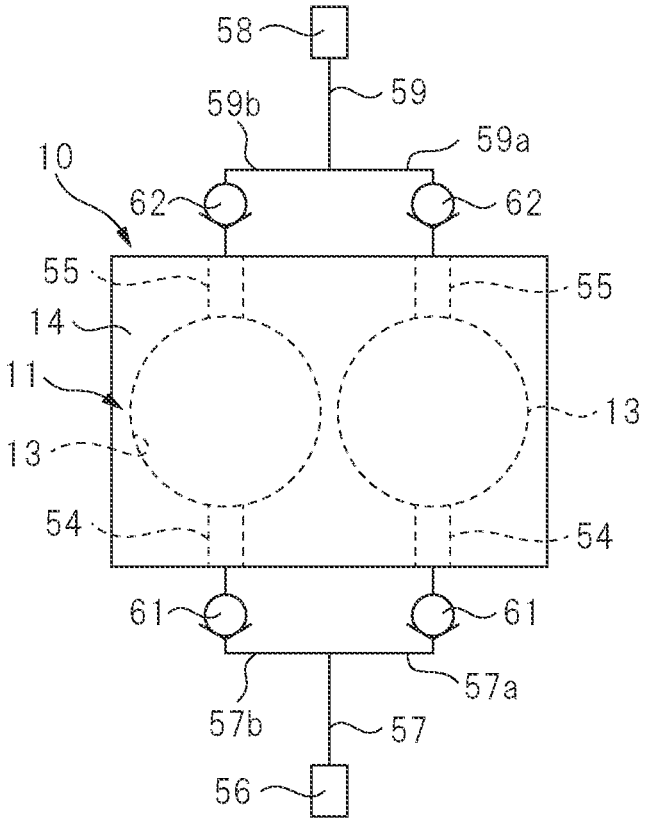
FIG. 6 is a view showing a side surface of FIG. 2 and piping of the liquid supply device.

Hereinafter, embodiments of the present invention will be described in detail with reference to the drawings. As shown in FIGS. 1 to 3, a liquid supply device 10 has a pump unit 11 and a drive unit 12, and the pump unit 11 is attached to the drive unit 12. As shown in FIG. 3, the pump unit 11 has a pump block 14 in which two concave surfaces 13 are formed. The pump block 14, whose side surfaces are rectangular, is formed of a resin or metal, as shown in FIG. 6. The drive unit 12 has a housing 15, and the housing 15 includes a connection portion 15*a* to which the pump block 14 is attached, a front wall 15*b*, a rear wall 15*c*, right and left walls 15*d*, 15*e*, and a bottom wall 15*f*.

A first bellows 16*a* and a second bellows 16*b* made of a resin as pump members are arranged in the respective concave surfaces 13. The respective bellows 16*a*, 16*b* have the same structure, members for driving each of them are denoted by the same reference numerals, and each of the members has a head portion 17, an annular base portion 18, and a bellows portion 19 integrally provided between the head portion 17 and the annular base portion 18. A pump chamber 20 is formed between each of the bellows 16*a*, 16*b* and the concave surface 13, and each pump chamber 20 expands and contracts by extension and contraction of the bellows 16*a*, 16*b*.

A cylinder-shaped spring reception cylindrical body 21 is arranged inside each of the bellows 16*a*, 16*b*, and a flange 22 of the spring reception cylindrical body 21 and the annular base 18 of the bellows 16*a*, 16*b* are sandwiched between the pump block 14 and the housing 15. A plunger 23 is arranged inside the spring reception cylindrical body 21, a tip portion of the plunger 23 is screwed to the head portion 17, and the base end of the plunger 23 protrudes into a through-hole 24 formed in the housing 15. The spring reception member 25 is provided at the base end portion of the plunger 23. The spring reception member 25 may be integrated with the plunger 23, or the plunger 23 and the spring reception member 25 may be separate members.

A compression coil spring 27 is arranged outside the plunger 23, one end portion of the compression coil spring 27 abuts against a stepped portion of the spring reception cylindrical body 21, and the other end portion abuts against the spring reception member 25. A spring force directed downward in FIG. 3 is applied to the plunger 23 by a compression coil spring 27. The spring force in such directions that the head portion 17 is directed toward the annular base portion 18 and the bellows portion 19 is contracted in an axial direction is applied to the bellows 16*a*, 16*b* via the plunger 23, and if the bellows 16*a*, 16*b* contracts, the pump chamber 20 expands.

The plunger 23 is pressed by the spring force of the compression coil spring 27 against drive rods 28, each of which is indicated by symbol P in FIG. 3 and which can reciprocate in an axial direction, and the respective drive rods have the same structure. A cover portion 29 that covers the base end portion of the plunger 23 is provided at an upper end portion of the drive rod 28. A roller accommodation portion 31 is provided at a lower end portion of the drive rod 28, and the drive roller 32 is arranged in the roller accommodation portion 31. A support shaft 33 in a perpendicular direction, which is a lateral to a reciprocation direction P of the drive rod 28, is provided on the drive rod 28, and the drive roller 32 is attached on the support shaft 33. Consequently, the drive roller 32 rotates about a rotation center axis R that is lateral to the reciprocation direction of the drive rod 28 in the axial direction P. Each rotation center axis R is coaxial.

A guide cylinder 34 is attached to the through-hole 24 and, as shown in FIG. 4 (*a*) and FIG. 4(B), the guide cylinder 34 has a fit portion 35 fitted into the through-hole 24, and a guide portion 36 for guiding the drive rod 28. Guide rollers 37 are provided at both ends of the support shaft 33, and guide grooves 38 for guiding the guide rollers 37 are provided in a guide cylinder 34. The guide groove 38 contacts to the guide roller 37 and guides movement of the guide roller 37 in an up-down direction in FIGS. 2 and 3. Four slits 39 extending in the axial direction from a lower end surface of the guide portion 36 are formed in the lower end portion of the guide portion 36, and attachment holes 41 penetrating between a bottom surface of each slit 39 and an upper surface of the guide portion 36 are formed in the guide portion 36. The guide cylinder 34 is fixed to the housing 15 by bolts 42 attached to the respective attachment holes 41.

A cam member 43 is provided on the housing 15 so as to be rotatable about a rotation center axis O parallel to the reciprocation direction P of the drive rod 28, and the cam member 43 is supported by a bottom wall 15*f* of the housing 15 via a thrust bearing 44. An electric motor 45 as a rotation drive source is attached to the bottom wall 15*f*, an output shaft 46 of the electric motor 45 is attached to the cam member 43, and the cam member 43 is rotated by the electric motor 45. The cam member 43 is accommodated in a drive chamber 47 formed between the connection portion 15*a* of the housing 15 and the bottom wall 15*f*.

FIG. 5(A) is a plan view of the cam member 43, and FIG. 5(B) is a sectional view taken along line A-A in FIG. 5(A). The cam member 43 is an end surface cam in which an annular cam surface 48 is formed on an outer peripheral portion of an end surface of a disk-shaped member. The cam surface 48 has a projecting surface 49 protruding toward the pump unit 11, a retreating surface 50 at a position retreated from the cam member 43 and shifted by 180 degrees in a rotation direction S of the cam member 43, and an inclined surface 51 therebetween. In FIG. 2, the projecting surface 49 is shown on a right side of the cam member 43 and the retreating surface 50 is shown on a left side of the cam member 43. In FIG. 3, the projecting surface 49 is shown in the center portion of the cam member 43 without showing the entire cam member 43 as a cross section.

Two drive rollers 32 are shifted by 180 degrees in the rotation direction of the cam member 43 with respect to the cam member 43, and when one drive roller 32 contacts the projecting surface 49, the other drive roller 32 contacts with the retreating surface 50. For example, when the drive roller 32 attached to the one drive rod 28 for driving the first bellows 16*a* contacts with the projecting surface 49, the one drive rod 28 becomes a rise end position in FIGS. 2 and 3. Consequently, the head portion 17 of the bellows 16*a* becomes the rise end position, the bellows portion 19 becomes an extended state, that is, an elongated state, and the pump chamber 20 is contracted by the bellows 16*a*.

At this time, the drive roller 32 attached to the other drive rod 28 for driving the second bellows 16*b* contacts with the retreating surface 50 due to the spring force. Consequently, the other drive rod 28 becomes a fall end position, the head portion 17 of the bellows 16*b* becomes a fall end position, and the bellows portion 19 becomes a contracted state. When the bellows portion 19 becomes the contracted state, the pump chamber 20 is expanded by the bellows 16*b*. Thus, the rotation of the cam member 43 causes the two bellows 16*a* and 16*b* to alternately elongate and contract, and are driven at different timing. Consequently, the two pump chambers 20 alternately expand and contract.

As shown in FIG. 5(B), if it is assumed that an axial length of a portion of the cam member 43, which the projecting surface 49 is formed, is L1 and an axial length of a portion, which the retreating surface 50 is formed, is L2, the portion on which the projecting surface 49 is formed is a portion having the longest length in the axial direction with respect to the other portions.

Lubricating oil is applied to rotation members such as the driving roller 32 and the guide roller 37 in the drive chamber 47 and to members with which the rotation members contact. In order to prevent the lubricating oil in the drive chamber 47 from flowing out toward the plunger 23 and the pump block 14, a seal member 52 is attached between the guide cylinder 34 and the drive rod 28, and a seal member 53 is attached between the guide cylinder 34 and the housing 15.

As shown in FIG. 6, suction ports 54 are formed in the bottom surface of the pump block 14 so as to communicate with the respective pump chambers 20, and discharge ports 55 are formed in the top surface of the pump block 14. A suction side pipe 57 is connected to the liquid tank 56 into which the liquid is injected, and branch portions 57*a*, 57*b* of the suction side pipe 57 are connected to the suction ports 54. A discharge side pipe 59 is connected to a discharge member 58, and branch portions 59*a*, 59*b* of the discharge side pipe 59 are connected to the discharge ports 55. A check valve 61 is provided in each of the branch portions 57*a*, 57*b*, the check valve 61 operating at a state of supplying the liquid from the liquid tank 56 to the pump chamber 20 via the suction side pipe 57 and at a state of preventing a reverse flow of the liquid. Further, a check valve 62 is provided in each of the branch portions 59*a*, 59*b*, the check vale 62 operating at a state of discharging the liquid from the pump chamber 20 to the discharge member 58 via the discharge side pipe 59 and at a state of preventing the reverse flow of the liquid. Note that in FIGS. 1 to 3, the suction side pipe 57, the discharge side pipe 59, and the like shown in FIG. 6 are omitted from illustration.

In order to drive the liquid supply device 10 and discharge the liquid in the liquid tank 56 to the discharge member 58, the electric motor 45 is driven to rotate the output shaft 46. When the output shaft 46 is rotated, the cam member 43 is rotated around the rotation center axis O and the two bellows 16*a*, 16*b* are driven at different timing via the plunger 23 by the drive roller 32 contacting with the cam surface 48. That is, when the one bellows 16*a* elongates to discharge the liquid from the one pump chamber 20 to the discharge member 58, the other bellows 16*b* contracts to inject the liquid from the liquid tank 56 into the other pump chamber 20. At this time, a contraction motion of the bellows 16*b* is performed by the spring force of the compression coil spring 27. Consequently, the liquid is continuously discharged from the liquid supply device 10 to the discharge member 58 at a constant discharge amount. Note that a position of the suction port 54 is not limited on a bottom surface side as long as the position is inside the pump block 14. Similarly, a position of the discharge port 55 is not limited on an upper surface side.

In FIG. 5(B), the axial length of the portion of the cam surface 48, at which the projecting surface 49 is formed, is L1 and the portion of the cam member 43 having the longest axial length, that is, the portion of L1 becomes a thick portion 63. A portion, which has the length of L2 in the axial direction and is at the position shifted by 180 degrees in the rotation direction with respect to the thick portion 63 and on which the retreating surface 50 is formed, becomes a thin portion 64.

Figure 7:
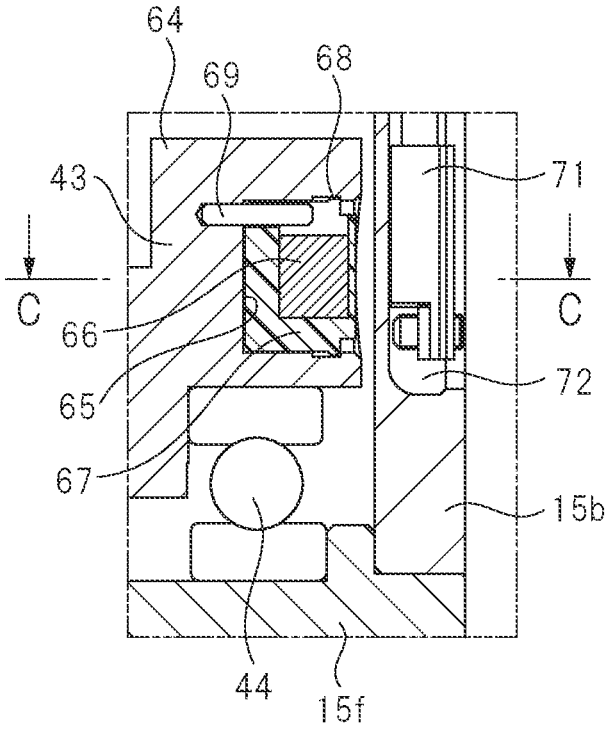
FIG. 7 is an enlarged sectional view of a portion B in FIG. 2.
Figure 8:
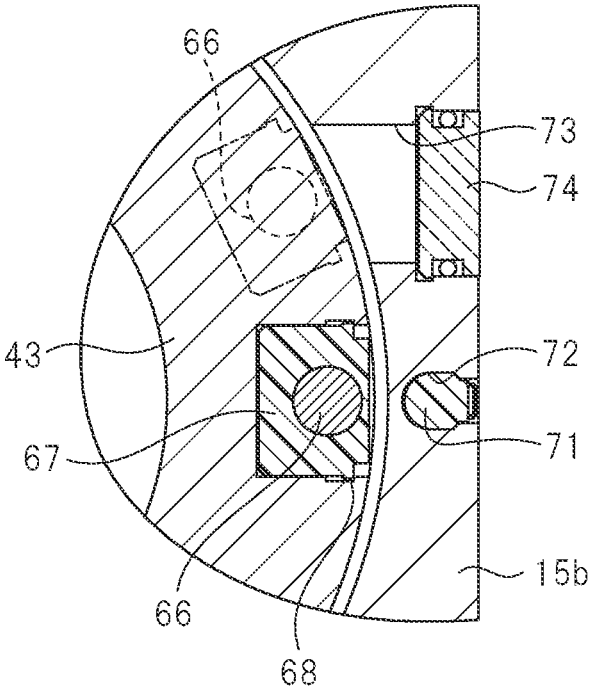
FIG. 8 is a sectional view taken along line C-C in FIG. 7.
Figure 9:
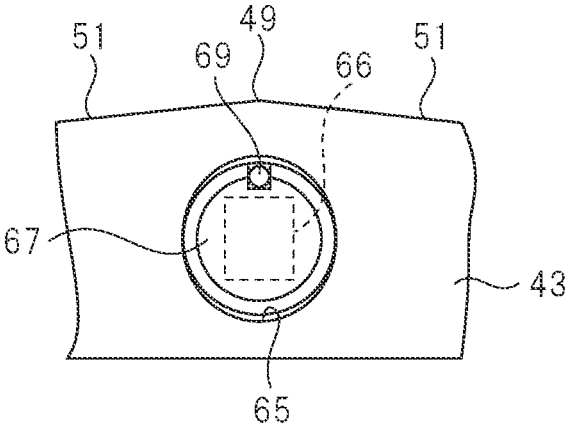
FIG. 9 is an enlarged front view of a portion D in FIG. 3.

FIG. 7 is an enlarged sectional view of a portion B in FIG. 2, FIG. 8 is a sectional view taken along line C-C in FIG. 7, and FIG. 9 is an enlarged sectional view of a portion D in FIG. 3.

As shown in FIGS. 7 to 9, a magnet accommodation hole 65 is formed in the outer peripheral portion of the cam member 43, and the magnet accommodation hole 65 opens to an outer peripheral surface of the cam member 43. The magnet accommodation hole 65 is formed in the thick portion 63 having the longest axial length in the outer peripheral portion of the cam member 43. A magnet 66 is arranged in the magnet accommodation hole 65, and the magnet 66 is covered with a magnet holder 67 made of a resin which is a non-magnetic material. The magnet 66 has a cylindrical shape, and the upper and lower end surfaces in FIG. 7 have opposite polarities. The magnet 66 is arranged close to an outer peripheral portion side of the cam member 43, and a thickness of the magnet holder 67 on the outer peripheral portion side of the cam member 43 is set thin. The magnet holder 67 is prevented from coming off by engaging the cam member 43 with a claw portion 68 formed on the outer peripheral portion, and the rotation of the magnet holder 67 is prevented by a pin 69 attached to the cam member 43.

The magnet 66 is provided in the portion L1 having the longest length in the axial direction of the cam member 43, that is, in the thick portion 63. By this way, the thick portion 63 for forming the projecting surface 49 is used to arrange the magnet 66 there, so that the magnet 66 can be incorporated into the cam member 43 without enlarging magnitude of the cam member 43 in the axial direction. However, in FIG. 5(B), the magnet is not shown in the thick portion 63 on which the projecting surface 49 is formed.

A magnetic sensor 71 is provided on a front wall 15*b* of a housing 15. The magnetic sensor 71 is incorporated in an accommodation groove 72 formed in the front wall 15*b* correspondingly to the position of the magnet 66, as shown in FIGS. 2 and 7. Therefore, when the cam member 43 rotates, a magnetic field of the magnet 66 passes through the magnet holder 67 and is applied to the magnetic sensor 71 every rotation, and the magnetic sensor 71 responds to a magnetic force of the magnet 66 and outputs a rotation signal. An output signal from the magnetic sensor 71 is outputted to a control unit (not shown), and the control unit determines whether the cam member 43 is rotating. If the cam member is rotating, the number of revolutions of the cam member 43 per unit time is calculated.

When the magnet holder 67 is absent, the magnetic field of the magnet 66 cannot be detected by the magnetic sensor 71 if the cam member 43 is made of a magnetic material. A magnetic material can be used for the cam member 43 when the magnet 66 covered with the non-magnetic magnet holder 67 is arranged in the magnet accommodation hole 65.

As shown in FIGS. 1 and 8, an observation window 73 is provided in the housing 15. The observation window 73 is provided on the front wall 15*b* adjacent to the magnetic sensor 71 so that a position in its up-down direction in FIG. 1 correspond to the magnetic sensor 71. A location at which the magnet 66 is provided in the cam member 43 can visually recognized from an outside of the housing 15. Consequently, an operator(s) can observe the rotation of the cam member 43 from outside the liquid supply device 10. By making one or both of the magnet holder 67 and the magnet 66 a different color from that of the cam member 43, visibility is improved. In order to prevent foreign matters from being mixed into the drive chamber 47 from the outside, a transparent cover member 74 is attached to the observation window 73. FIG. 8 shows by a dash-double-dot line that the magnet 66 is at a position of the observation window 73.

Lubricating oil is applied to a sliding portion and a rotating portion in the drive chamber 47, and the rotation of the cam member cannot be detected by an optical sensor. In contrast, since the rotation of the cam member 43 and the rotation of the output shaft 46 of the electric motor 45 are detected by using the magnetic sensor 71 that senses the magnetic force of the magnet 66, the rotation of the cam member 43 can be reliably detected.

The present invention is not limited to the above-described embodiments, and various modifications can be made without departing from the gist of the present invention. For example, although the above-mentioned liquid supply device 10 includes two bellows 16*a*, 16*b* as pump members, the number of bellows is not limited to two, and may be three or more as long as it is plural. The pump member is not limited to the above-mentioned bellows, and may be a piston or a tubephragm. Also, the magnet accommodation hole 65 may be provided in a portion other than the thick portion of the cam member 43. Further, a rotation drive source is not limited to the electric motor, and an air motor can also be used. Moreover, a stepping motor, a servo motor, or an induction motor can be used as the electric motor.

INDUSTRIAL APPLICABILITY

A liquid supply device is applied to supply a liquid to an object to be coated, for example, like a case of applying a liquid such as a photoresist liquid on a surface of a liquid crystal display substrate.

The invention claimed is:

1. A liquid supply device comprising:

a pump unit provided with a first pump member for expanding and contracting a first pump chamber and a second pump member for expanding and contracting a second pump chamber;

a housing incorporating a first drive rod and a second drive rod for driving the first pump member and the second pump member at different timing;

a first drive roller provided on the first drive rod and rotating around a rotation center axis in a direction lateral to a reciprocating direction of the first drive rod;

a second drive roller provided on the second drive rod and rotating around a rotation center axis in a direction lateral to a reciprocating direction of the second drive rod;

a cam member whose end surface a cam surface contacted by the first drive roller and the second drive roller is provided on and that is rotated around a rotation center axis parallel to the reciprocating directions of the first drive rod and the second drive rod by a rotation drive source;

a magnet provided on an outer peripheral portion of the cam member; and a magnetic sensor provided in the housing and sensing a magnetic force of the magnet to output a rotation signal, wherein the housing is provided with an observation window through which the outer peripheral portion of the cam member provided with the magnet can be viewed from outside the housing.

2. A liquid supply device comprising:

a pump unit provided with a first pump member for expanding and contracting a first pump chamber and a second pump member for expanding and contracting a second pump chamber;

a housing incorporating a first drive rod and a second drive rod for driving the first pump member and the second pump member at different timing;

a first drive roller provided on the first drive rod and rotating around a rotation center axis in a direction lateral to a reciprocating direction of the first drive rod;

a second drive roller provided on the second drive rod and rotating around a rotation center axis in a direction lateral to a reciprocating direction of the second drive rod;

a cam member whose end surface a cam surface contacted by the first drive roller and the second drive roller is provided on and that is rotated around a rotation center axis parallel to the reciprocating directions of the first drive rod and the second drive rod by a rotation drive source;

a magnet provided on an outer peripheral portion of the cam member; and a magnetic sensor provided in the housing and sensing a magnetic force of the magnet to output a rotation signal, wherein the cam member is made of a magnetic material and has a magnet holder covering the magnet and made of a non-magnetic material, and a magnetic field formed by the magnet passes through magnet holder to be applied to the magnetic sensor.

3. A liquid supply device comprising:

a pump unit provided with a first pump member for expanding and contracting a first pump chamber and a second pump member for expanding and contracting a second pump chamber;

a housing incorporating a first drive rod and a second drive rod for driving the first pump member and the second pump member at different timing;

a first drive roller provided on the first drive rods and rotating around a rotation center axis in a direction lateral to a reciprocating direction of the first drive rod;

a second drive roller provided on the second drive rod and rotating around a rotation center axis in a direction lateral to a reciprocating direction of the second drive rod;

a cam member whose end surface a cam surface contacted by the first drive roller and the second drive roller is provided on and that is rotated around a rotation center axis parallel to the reciprocating directions of the first drive rod and the second drive rod by a rotation drive source;

a magnet provided on an outer peripheral portion of the cam member; and a magnetic sensor provided in the housing and sensing a magnetic force of the magnet to output a rotation signal, wherein rotation center axes of the first drive roller and the second drive roller are coxial, the cam surface has a projection surface protruding toward the housing, a retracting surface that is shifted by 180 degrees in a rotation direction from the projection surface and is located at a position retracted from the projection surface, and an inclined surface between the projection surface and the retracting surface, and the magnet is arranged on a thick portion of the cam member provided with the projection surface.

4. The liquid supply device according to claim 1, wherein the first pump member is a first bellows forming the first pump chamber with a concave surface formed in the housing, the second pump member is a second bellows forming the second pump chamber with a concave surface formed in the housing, and each of the first bellows and the second bellows has an annular base portion sandwiched between the pump unit and the housing, a head portion attached to the drive rod and reciprocates, and a bellows portion between the annular base portion and the head portion.

5. The liquid supply device according to claim 1, wherein a first guide cylinder that reciprocably guides the first drive rod is attached to the housing, a second guide cylinder that reciprocably guides the second drive rod is attached to the housing, a first guide roller is provided at both ends of a support shaft on which the drive roller is provided, a second guide roller is provided at both ends of a support shaft on which the second drive roller is provided, a guide groove for guiding the first guide roller is provided in the first guide cylinder, and a guide groove for guiding the second guide roller is provided in the second guide cylinder.

6. The liquid supply device according to claim 2, wherein the first pump member is a first bellows forming the first pump chamber with a concave surface formed in the housing, the second pump member is a second bellows forming the second pump chamber with a concave surface formed in the housing, and each of the first bellows and the second bellows has an annular base portion sandwiched between the pump unit and the housing, a head portion attached to the drive rod and reciprocates, and a bellows portion between the annular base portion and the head portion.

7. The liquid supply device according to claim 3, wherein the first pump member is a first bellows forming the first pump chamber with a concave surface formed in the housing, the second pump member is a second bellows forming the second pump chamber with a concave surface formed in the housing, and each of the first bellows and the second bellows has an annular base portion sandwiched between the pump unit and the housing, a head portion attached to the drive rod and reciprocates, and a bellows portion between the annular base portion and the head portion.

8. The liquid supply device according to claim 2, wherein a first guide cylinder that reciprocably guides the first drive rod is attached to the housing, a second guide cylinder that reciprocably guides the second drive rod is attached to the housing, a first guide roller is provided at both ends of a support shaft on which the first drive roller is provided, a second guide roller is provided at both ends of a support shaft on which the second drive roller is provided, a guide groove for guiding the first guide roller is provided in the first guide cylinder, and a guide groove for guiding the second guide roller is provided in the second guide cylinder.

9. The liquid supply device according to claim 3, wherein a first guide cylinder that reciprocably guides the first drive rod is attached to the housing, a second guide cylinder that reciprocably guides the second drive rod is attached to the housing, a first guide roller is provided at both ends of a support shaft on which the first drive roller is provided, a second guide roller is provided at both ends of a support shaft on which the second drive roller is provided, a guide groove for guiding the first guide roller is provided in the first guide cylinder, and a guide groove for guiding the second guide roller is provided in the second guide cylinder.

* * * * *